US005644935A

United States Patent [19]

Jonovich et al.

[11] Patent Number: 5,644,935

[45] Date of Patent: Jul. 8, 1997

[54] DECORATIVE THIGH CIRCLET

[76] Inventors: Gregory Thomas Jonovich; Joyce Lillie Jonovich, both of 4310 N. 30th St., Phoenix, Ariz. 85016

[21] Appl. No.: 351,832

[22] Filed: Dec. 8, 1994

[51] Int. Cl.[6] ..... A44C 25/00

[52] U.S. Cl. ..... 63/4; 63/3.2

[58] Field of Search ..... 63/2, 24; 2/318, 2/303, 312, 313, 314, 316

[56] References Cited

U.S. PATENT DOCUMENTS

| | | | |
|---|---|---|---|
| 1,014,009 | 1/1912 | Koons | 2/303 |
| 1,359,672 | 11/1920 | Cavalier | 2/313 |
| 1,628,278 | 5/1927 | Scheuer | 63/2 |
| 1,909,120 | 5/1933 | Rigante | 2/313 |
| 3,481,155 | 12/1969 | Cook | 63/2 |

FOREIGN PATENT DOCUMENTS

| | | | |
|---|---|---|---|
| 783202 | 7/1935 | France | 63/2 |
| 376538 | 10/1922 | Germany | 2/303 |
| 221673 | 9/1924 | United Kingdom | 63/2 |

*Primary Examiner*—Michael J. Milano

*Attorney, Agent, or Firm*—Charles E. Cates; Richard G. Harrer

[57] ABSTRACT

An article of jewelry adapted to be worn over a human thigh. Included in the article is a substantially closed circlet having a length and flexibility that allows it to be draped loosely around the thigh. Supporting the circlet is a suspension member that is adapted to hang from an undergarment of the wearer. A link member loosely and slidably couples the suspension member to the circlet, allowing the circlet to move smoothly without irritating the skin of the wearer.

17 Claims, 1 Drawing Sheet

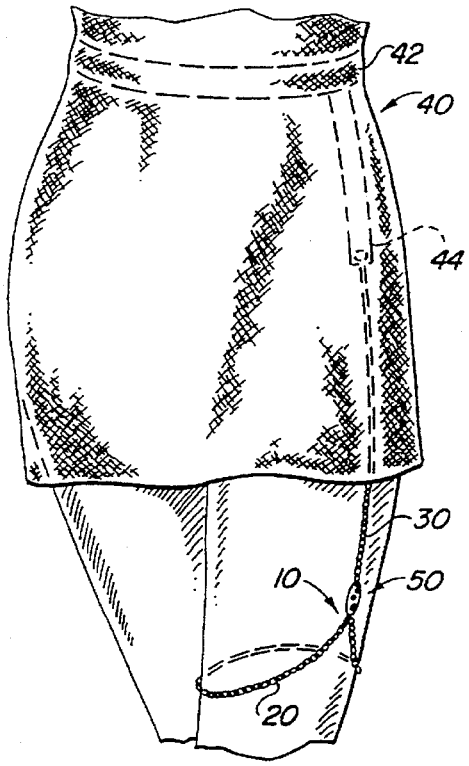
FIG. 1
FIG. 3
FIG. 4
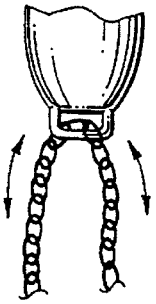
FIG. 5
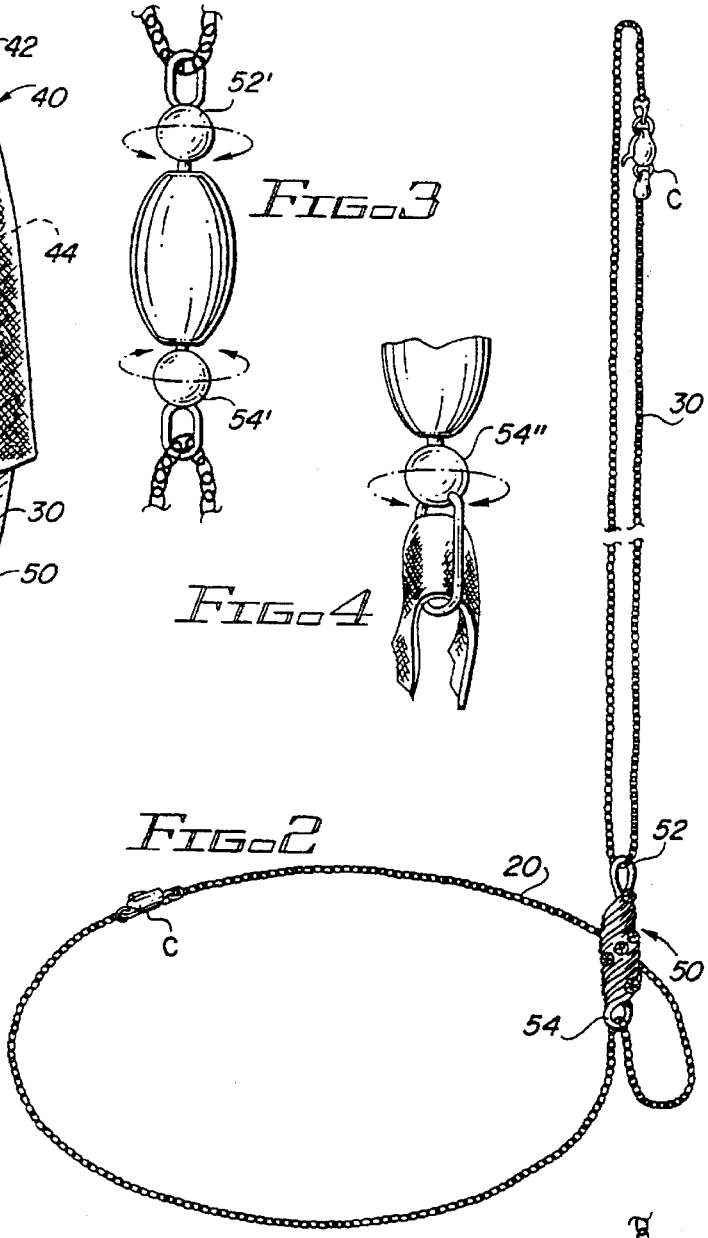
FIG. 2
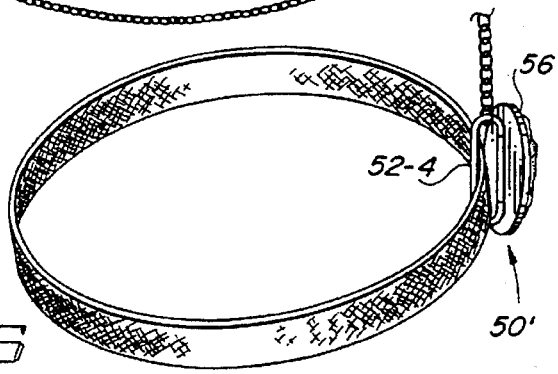
FIG. 6

DECORATIVE THIGH CIRCLET

BACKGROUND OF THE INVENTION

The present invention relates to articles of jewelry, and is directed more particularly to an article of jewelry that is adapted to be worn on a human thigh.

Many types of decorative articles have been designed to be worn as fashion statements or fashion accents on various parts of the human body. One type of such articles includes articles, such as tiaras and rings, which are inelastic and inflexible and which are worn in fixed positions on a wearer's body. Another type of such articles includes articles, such as necklaces and bracelets, which are inelastic but flexible and which are worn on parts of the body having naturally rententive shapes such as, for example, the neck, the waist, the wrist and the ankle. A third type of such articles includes articles, such as armbands and garters, which are elastic and flexible and which are worn on parts of the body that lack naturally rententive shapes such as, for example, the upper arm and the thigh.

With decorative articles of the last of the above-mentioned types, the only possibility for producing the eye-catching motions that characterize necklaces and bracelets has involved the use of decorative items that hang downwardly from the associated elastic support members. While such decorative articles are beautiful and eye catching, they have the practical disadvantage that the items hung thereon have a tendency to catch on things such as the clothing or jewelry of other persons, particularly during dancing, or to come into contact with food items during meals.

SUMMARY OF THE INVENTION

In accordance with the present invention there is provided a new article of jewelry which is specially adapted to be worn on the thigh, which is flexible enough to serve as an eye catching and movable fashion accessory, and which has little tendency to come into unwanted contact with nearby items or to irritate the skin of the wearer. The article of the present invention may, therefore, properly be thought of as defining a new kind of fashion accessory, namely: an article which is flexible and inelastic, but which is adapted to be worn on a part of the body which lacks a naturally retentive shape.

Generally speaking, the article of the invention comprises a thigh circlet that hangs from an elongated suspension member that is, in turn, suspended from an undergarment of the wearer. The circlet preferably takes the form of a chain or strap which is sufficiently limp that it takes on a curvilinear shape similar to that of the thigh. The curvilinear length of the circlet (hereinafter sometimes referred to as the length or lateral dimension thereof) is selected so that the circlet fits around the thigh neither so tightly that it has little freedom to move, nor so loosely that it hangs limply down along the thigh. Instead, the curvilinear length of the circlet is selected so that it drapes itself gracefully around the thigh to take on a complex, non-planar curvilinear shape which, over much of its length, follows the curvature of the thigh but which, over the remainder of its length, comes to a point as it nears the suspension member. Stated differently, the flexibility and length of the circlet together cause the circlet to adopt an aesthetically pleasing shape that resembles a bent teardrop which is suspended roughly horizontally around the thigh.

In accordance with an important feature of the invention, the circlet is coupled to the suspension member by means of a link member having one or more loops (or, more generally, apertures) through which one or both of the circlet and suspension member are loosely and slidably threaded. The looseness and lateral slidability of this coupling allows the circlet to move smoothly and rythmically over the thigh as the wearer walks and dances, adding the effect of graceful fluid motion to the already aesthetically pleasing effect of its shape. This looseness and slidability has also been found to contribute importantly to the comfort of the wearer, since it eliminates the tendency of a tightly suspended circlet to scrape and irritate the skin of the wearer.

The present invention also contemplates the inclusion of new and aesthetically pleasing designs including jewels, sculptured shapes, etc. on at least the outward facing part of the link. When so used, the link serves the additional purpose of supporting and/or embodying such designs and the personalized fashion statements they make. It will therefore be understood that the article of the invention has a design aspect as well as a utility aspect.

DESCRIPTION OF THE DRAWINGS

Other objects and advantages of the thigh jewelry of the invention will be apparent from the following description and drawings, in which:

FIG. 1 is an oblique view of the thigh circlet of the invention shown in the position in which it is worn;

FIG. 2 is an oblique view of the thigh circlet of FIG. 1 which is enlarged to more clearly show the ornamental design which is embodied therein and displayed thereby;

FIGS. 3 through 5 and are enlarged fragmentary views of various link configurations that may be used in the thigh circlet of the invention; and FIG. 6 is an oblique fragmentary view of a thigh circlet which takes the form of a flexible strap.

DESCRIPTION OF THE PREFERRED EMBODIMENTS

Referring to FIG. 1 there is shown an article 10 of thigh jewelry constructed in accordance with the present invention, shown in the position in which it is preferably worn. As shown in FIG. 1, article 10 includes a flexible circlet 20 which is draped somewhat loosely or semi-taughtly around the thigh, an elongated flexible lower suspension member 30 which is seperate from circlet 20 and which extends downwardly from under an outer garment of the wearer, and an upper suspension device or article 40 which preferably includes an elastic belt 42 having a downwardly hanging strap 44. Both circlet 20 and suspension member 30 may be provided with a clasp C for use in putting them on and taking them off.

Upper suspension article 40 may comprise a complete special purpose garment worn around the waist solely for the purpose of suspending article 10, or an accessory adapted to be attached to a general purpose garment such as a garter belt (not shown) of the type commonly worn to support ladies hosiery. Upper suspension device 40 may also, however, comprise an elastic garter which supports the upper end of suspension member 30 from a point on the upper thigh, rather than from the waist. The types and locations of such upper suspension devices are not important, so long as they provide the required vertical support. It will therefore be understood that all types and locations of upper suspension devices are within the contemplation of the present invention.

In accordance with one important feature of the present invention, circlet 20 has a composition and/or structure which gives it a flexibility that allows it to conform its shape to the natural shape of the thigh. Circlet 20 may, for example, have a chain-like structure, such as that shown in FIGS. 1 through 3 and 5 which is flexible by virtue of its construction, in spite of its being composed of an inelastic material. Alternatively, circlet 20 may have a strap or ribbon-like structure, such as that shown in FIGS. 4 and 6, which is flexible by virtue of its composition, e.g., silk or velvet, in spite of its construction.

In accordance with another important feature of the present invention, circlet 20 has a curvilinear or lateral length that enables it to form itself into an aesthetically pleasing closed non-planar curve that encircles the thigh while adopting an orientation which is more nearly horizontal than vertical, as is best shown in FIG. 1. If this length is too short, circlet 20 will approximate a condition of taughtness which is uncomfortable and which restricts its ability to move in a smoothly fluid and aesthetic manner. If this length is too long, circlet 20 will be able to move but will hang so far downwardly on the thigh as to suggest sag and lack of energy. When the optimum length is achieved, circlet 20 will seat on the thigh high enough and horizontally enough to suggest youthful firmness and energy. If desired, the length of circlet 20 may be optimized for the thigh dimensions of a particular wearer by adding or removing links to or from the chain as necessary to produce the desired "look".

To the end that circlet 20 may move, slide and sway freely and smoothly over the thigh, circlet 20 is suspended from suspension member 30 by means of a link 50 that couples these elements together relatively loosely. In the preferred embodiment, shown in FIGS. 1 and 2, this loose coupling is assured by including at the upper end of link 50 a loop or opening 52, which is large relative to the cross-section of suspension member 30, so that suspension member 30 may be loosley threaded therethrough, and by including at the lower end of link 50 a loop or opening 54 which is large relative to the cross-section of circlet 20, so that circlet 20 may be loosely threaded therethrough. Once so threaded, circlet 20 is free to move and pivot freely around the interior of the loop and to slide laterally through the loop, without being exposed to the binding forces that tend to cause the motion of the circlet to be jerky. The looseness of the coupling provides the additional benefit of protecting the wearer from the scrapes and abrasion that can occur when chains 20 and 30 are tightly coupled together at a single fixed point.

If desired, the freedom of movement of circlet 20 with respect to suspension chain 30 may be further increased by coupling one or both of these elements to the main body of the link by swivelable loops such as those shown at 52' and 54' of the embodiment of FIG. 3. A swivelable loop 54" of this type is particularly desirable in an embodiment, such as that shown in FIG. 4, which is designed for use with a strap-like rather than a chain-like circlet.

In accordance with the present invention, the link member serves not only to loosely couple the circlet to the suspension member, but also to embody or support and thereby display an ornamental design that enhances the aesthetic value of the article as a whole. In the preferred embodiment, shown in FIGS. 1 and 2, the link combines its coupling and display functions by embodying a jewelled encrusted spiral design into the portion of link 50 which extends between loops 52 and 54. Because the width of link 50 of FIG. 2 is greater than its depth, only the outer surface thereof will ordinarily be visible to an observer, the inner surface thereof being flat and smooth, except for the presence of a copyright notice. As shown in FIG. 6, however, the link may separate its coupling and display functions by being constructed so that a separately formed display element, such as a cameo 56, is supported on a coupling element, such as loop 52–4, that is ordinarily hidden from view. Since these two types of links may be used interchangeably, depending upon the desired aesthetic effect, it will be understood that they are equivalent for purposes of the present invention.

Referring to FIG. 6 there is shown an embodiment of the thigh circlet of the invention which uses a link 50' having a coupling structure different from that shown in FIGS. 1–5. The principal difference between the embodiment of FIG. 6 and the embodiments of FIGS. 1–5 is that, in the embodiment of FIG. 6, a single coupling loop 52–4 having a single opening is used to threadedly receive both circlet 20 and suspension member 30. Because this single coupling loop performs the functions of both of the separate coupling loops of the previously described embodiments, it will be understood to be the equivalent thereof for purposes of the present invention.

In view of the foregoing, it will be seen that, in spite of their different configurations, the link and suspension members of all of the embodiments of FIGS. 1 through 6 serve the function of loosely and slidably supporting the associated circlets and of displaying a design element. In addition, in spite of the fact that the circlet may be separate from or integral with the suspension member, both interact with their respective link members in substantially the same way to produce the desired appearance and motion. It will therefore be understood that the various suspension, circlet and linking structures shown in FIGS. 1 through 6 are interchangeable and equivalent for purposes of the present invention.

While the present invention has been described with reference to a number of specific embodiments, it will be understood that the true spirit and scope of the present invention should be determined with reference to the appended claims.

What is claimed is:

1. An Article of adornment adapted to be worn on the person, comprising:

a) an elongated flexible suspension means having an upper end and a lower end;

b) a flexible circlet having a length and a cross-section attached to said lower end of said suspension means and having a dimension large enough to allow said circlet to be draped loosely around a selected human body part:

c) a link means having a rigid opening larger than the cross-section of said circlet, for movably coupling said circlet and said suspension member;

d) said circlet having a substantially rounded cross-section that causes said circlet, in combination with said opening, to pivot around its longitudinal axis within said opening and to slide along its longitudinal axis within said opening responsively to motion of the human body part, without substantial deformation of said rigid opening.

2. The article of claim 1 in which said flexible circlet has a chain-like structure.

3. The article of claim 1 wherein said article of adornment comprises an article of jewelry adapted to be worn on a human body part.

4. The article of claim 1 in which the lateral dimension of said circlet is such that, when the circlet is worn, it forms itself into a teardrop shaped curve which is oriented roughly horizontally.

5. The article of claim 1 in which said link means further comprising an opening for receiving said suspension member.

6. The article of claim 1 in which said opening is defined by a loop member that is swivelly attached to said link.

7. The article of claim 1 in which said link embodies or supports an ornamental design element.

8. The article of claim 4 in which said link embodies or supports an ornamental design element.

9. An article of jewelry adapted to be worn over the thigh of a human wearer, comprising:

a) an elongated flexible suspension member having an upper end and a lower end, said suspension member being adapted to hang downwardly from a garment of the wearer;

b) a circlet having a length which allows it to form a semi-taughtly hanging loop when suspended in encircling relationship to the thigh;

c) linking means having a rigid opening larger than a cross-section of the circlet for loosely connecting said suspension member and said circlet;

d) said circlet having a substantially rounded cross-section that, in combination with said opening causes said circlet to pivot around its longitudinal axis within said opening while in use; without substantial deformation of said rigid opening.

10. The article of claim 9 in which said circlet comprises a chain.

11. The article of claim 9 on which said linking means includes a loop member that is swivelly attached to one end thereof.

12. The article of claim 9 in which said linking means defines an opening large enough to threadedly receive said suspension member whine allowing said circlet to slide therethrough.

13. The article of claim 9 in which said linking means carries an ornamental design.

14. A method of using an ornamental article on a human body part comprising the steps of:

a) furnishing an elongated flexible suspension means having an upper end and a lower end, a flexible circlet having a length and cross-section attached to said lower end of said suspension means and having a dimension large enough to allow said circlet to be draped loosely around a selected body part;

a link means having a rigid opening larger than the cross-section of said circlet for movably coupling said circlet and said suspension member, said circlet having a substantially rounded cross-section that permits said circlet to pivot around its longitudinal axis within said opening and to slide along its longitudinal axis within said opening without substantial deformation of said rigid opening;

b) placing said ornamental article on a body part;

c) causing said circlet to move in its intended manner by moving the body part.

15. The method of claim 14 Wherein the body part is a leg.

16. The method of claim 14 wherein the body part is an arm.

17. The method of claim 14 wherein said circlet has a small squarish cross-section.

* * * * *

UNITED STATES PATENT AND TRADEMARK OFFICE

CERTIFICATE OF CORRECTION

PATENT NO. : 5,644,935
DATED : July 8, 1997
INVENTOR(S) : Jonovich et al.

It is certified that error appears in the above-indentified patent and that said Letters Patent is hereby In Claim 12, line 33, the word "whine" should be deleted and the word --while-- should be inserted;

Col. 6

In Claim 15, line 26, the word "Wherein" should be deleted and the word --wherein-- should be inserted.

Signed and Sealed this

Twenty-fifth Day of November, 1997

*Attest:*

Bruce Lehman

BRUCE LEHMAN

*Attesting Officer*

*Commissioner of Patents and Trademarks*